US011982480B2

(12) United States Patent
Cole et al.

(10) Patent No.: US 11,982,480 B2
(45) Date of Patent: May 14, 2024

(54) REFRIGERATION SYSTEM WITH EMERGENCY COOLING USING DEDICATED COMPRESSOR

(71) Applicant: HEATCRAFT REFRIGERATION PRODUCTS LLC, Stone Mountain, GA (US)

(72) Inventors: Douglas Cole, Columbus, GA (US); Steve Pfister, Dunwoody, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 16 days.

(21) Appl. No.: 17/884,243

(22) Filed: Aug. 9, 2022

(65) Prior Publication Data

US 2024/0053076 A1 Feb. 15, 2024

(51) Int. Cl.

*F25B 49/02* (2006.01)
*F25B 31/00* (2006.01)
*F25B 41/20* (2021.01)

(52) U.S. Cl.

CPC ..... *F25B 49/022* (2013.01); *F25B 31/00* (2013.01); *F25B 41/20* (2021.01); *F25B 2400/0401* (2013.01); *F25B 2400/077* (2013.01); *F25B 2500/07* (2013.01); *F25B 2500/08* (2013.01)

(58) Field of Classification Search

CPC ..... F25B 49/022; F25B 31/00; F25B 41/20; F25B 2400/077; F25B 2400/0401; F25B 2500/07; F25B 2500/08

See application file for complete search history.

(56) References Cited

U.S. PATENT DOCUMENTS

| | | | | |
|---|---|---|---|---|
| 10,551,106 | B2 * | 2/2020 | Pfister | F25B 27/00 |
| 2019/0003756 | A1 * | 1/2019 | Pfister | F25B 27/00 |
| 2020/0124330 | A1 * | 4/2020 | Hayes | F25B 40/06 |
| 2021/0285702 | A1 * | 9/2021 | Shanmugam | F25B 5/02 |
| 2021/0364198 | A1 * | 11/2021 | Bittner | F24F 1/42 |

FOREIGN PATENT DOCUMENTS

| | | | | |
|---|---|---|---|---|
| CA | 3049596 | A1 * | 1/2020 | F25B 1/10 |
| WO | WO-2014179442 | A1 * | 11/2014 | F25B 49/022 |
| WO | WO-2022082094 | A1 * | 4/2022 | F25B 40/02 |

* cited by examiner

*Primary Examiner* — Kun Kai Ma
(74) *Attorney, Agent, or Firm* — Baker Botts L.L.P.

(57) ABSTRACT

A refrigeration system includes a high-pressure side with a gas cooler configured, while the refrigeration system is powered by a main power supply and is operating to provide refrigeration, to cool refrigerant on the high-pressure side. The refrigeration system includes a low-pressure side with one or more evaporators. The refrigeration system includes an auxiliary compressor coupled to a backup power supply. An input of the auxiliary compressor is coupled to fluid conduit of the low-pressure side, and an output of the auxiliary compressor is coupled to fluid conduit of the high-pressure side. A controller is communicatively coupled to the auxiliary compressor. After determining that the main power supply is unavailable, the controller causes the auxiliary compressor to turn on to move refrigerant from the low-pressure side to the high-pressure side.

18 Claims, 5 Drawing Sheets

REFRIGERATION SYSTEM WITH EMERGENCY COOLING USING DEDICATED COMPRESSOR

TECHNICAL FIELD

This disclosure relates generally to a refrigeration system. More specifically, this disclosure relates to a refrigeration system with emergency cooling using a dedicated compressor.

BACKGROUND

Refrigeration systems can be used to regulate the environment within an enclosed space. Various types of refrigeration systems, such as residential and commercial, may be used to maintain cold temperatures within an enclosed space such as a refrigerated case. To maintain cold temperatures within refrigerated cases, refrigeration systems control the temperature and pressure of refrigerant as it moves through the refrigeration system. When the system suffers from a power outage, the system can no longer refrigerate the enclosed space or keep its components cool. If heating occurs, this may create issues with the components that may damage the system or degrade system performance.

SUMMARY

Refrigeration systems may cycle a refrigerant to cool various spaces. For example, a refrigeration system may cycle refrigerant to cool spaces near or around refrigeration loads. In certain installations, such as at a grocery store, for example, a refrigeration system may include different types of loads. For example, a grocery store may use medium temperature loads and low temperature loads. The medium temperature loads may be used for produce, and the low temperature loads may be used for frozen foods. Refrigeration systems require a power supply in order to operate. In the case of a power outage, refrigerants (e.g., carbon dioxide) may start gaining heat such that the refrigerant temperature and pressure may rise and exceed the design pressure of the overall refrigeration system. The refrigeration system generally must be vented to the atmosphere in such a situation.

This disclosure provides improved refrigeration systems and methods of their operation during a power outage. The systems of this disclosure may be less complex than previous refrigeration systems designed to operate during power outages to prevent overheating and over-pressurization of system components. For instance, the systems may have fewer components and a more straightforward control scheme than was previously possible. The systems may also reduce the number of additional parts required in the system, thus creating a simpler system that utilizes fewer resources and requires less routine maintenance for its components. The systems may reduce or eliminate the need to vent refrigerant during a power outage, thereby reducing cost of materials and downtimes due to maintenance (e.g., to recharge the system with refrigerant). Certain embodiments of the disclosure may include none, some, or all of the above technical advantages. One or more other technical advantages may be readily apparent to one skilled in the art from the figures, descriptions, and claims included herein.

In an embodiment, a refrigeration system includes a high-pressure side with a gas cooler configured, while the refrigeration system is powered by a main power supply and is operating to provide refrigeration, to cool refrigerant on the high-pressure side. The refrigeration system includes a low-pressure side with one or more evaporators. Each of the one or more evaporators is configured, while the refrigeration system is powered by the main power supply and is operating to provide refrigeration, to cool a corresponding space. The refrigeration system includes an auxiliary compressor coupled to a backup power supply. An input of the auxiliary compressor is coupled to fluid conduit of the low-pressure side, and an output of the auxiliary compressor is coupled to fluid conduit of the high-pressure side. A controller is communicatively coupled to the auxiliary compressor. The controller determines that the main power supply is unavailable and, after determining that the main power supply is unavailable, causes the auxiliary compressor to turn on to move refrigerant from the low-pressure side to the high-pressure side.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1-5 of the drawings, like numerals being used for like and corresponding parts of the various drawings.

As described above, prior to this disclosure, there was a need for improved technology for efficiently and reliably providing backup operations for a refrigeration system during power outages. This disclosure recognizes a need for more efficient and easy-to-implement strategies for maintaining refrigerant temperatures at a sufficiently low value during power outages to reduce damage to the system and limit the loss of refrigerant. If the refrigerant reaches too high of a temperature, the refrigerant generally needs to be purged from the system, resulting in system downtimes for refrigerant recharge and associated costs. Previous strategies for operating refrigeration systems can be challenging to implement in existing systems because of the complexity of interconnections and controlling existing system components to a power switch to provide reliable operation during power outage conditions.

This disclosure provides improved refrigeration systems and associated strategies for operating refrigeration systems during power outages. As described with respect to FIGS. 1-5 below, the system includes a dedicated compressor that is connected to a backup or emergency power supply (e.g., a backup power generator). This dedicated compressor is operated when there is a power outage. The dedicated backup compressor may have a smaller capacity than the compressors conventionally used for other operations in the refrigeration system (e.g., the medium-temperature and low-temperature compressors described below with respect to FIGS. 1-3). This may, for example, facilitate the more efficient operation of the refrigeration system during a power outage, such that backup power is not wasted or consumed too quickly during a power outage.

Example Refrigeration Systems

Figure 1:
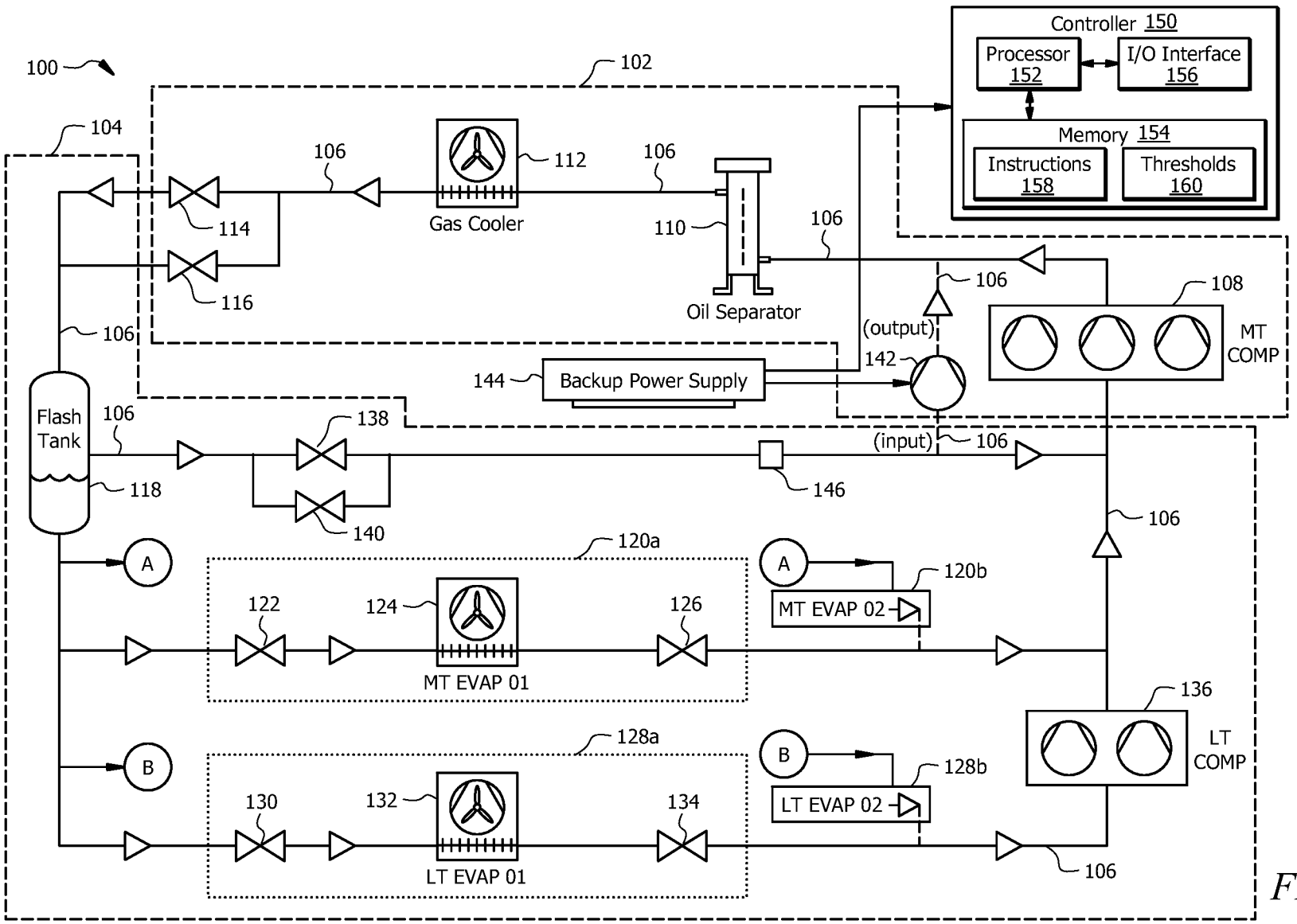
FIG. 1 is a block diagram illustrating an example refrigeration system of this disclosure operating in a normal refrigeration mode.
Figure 2:
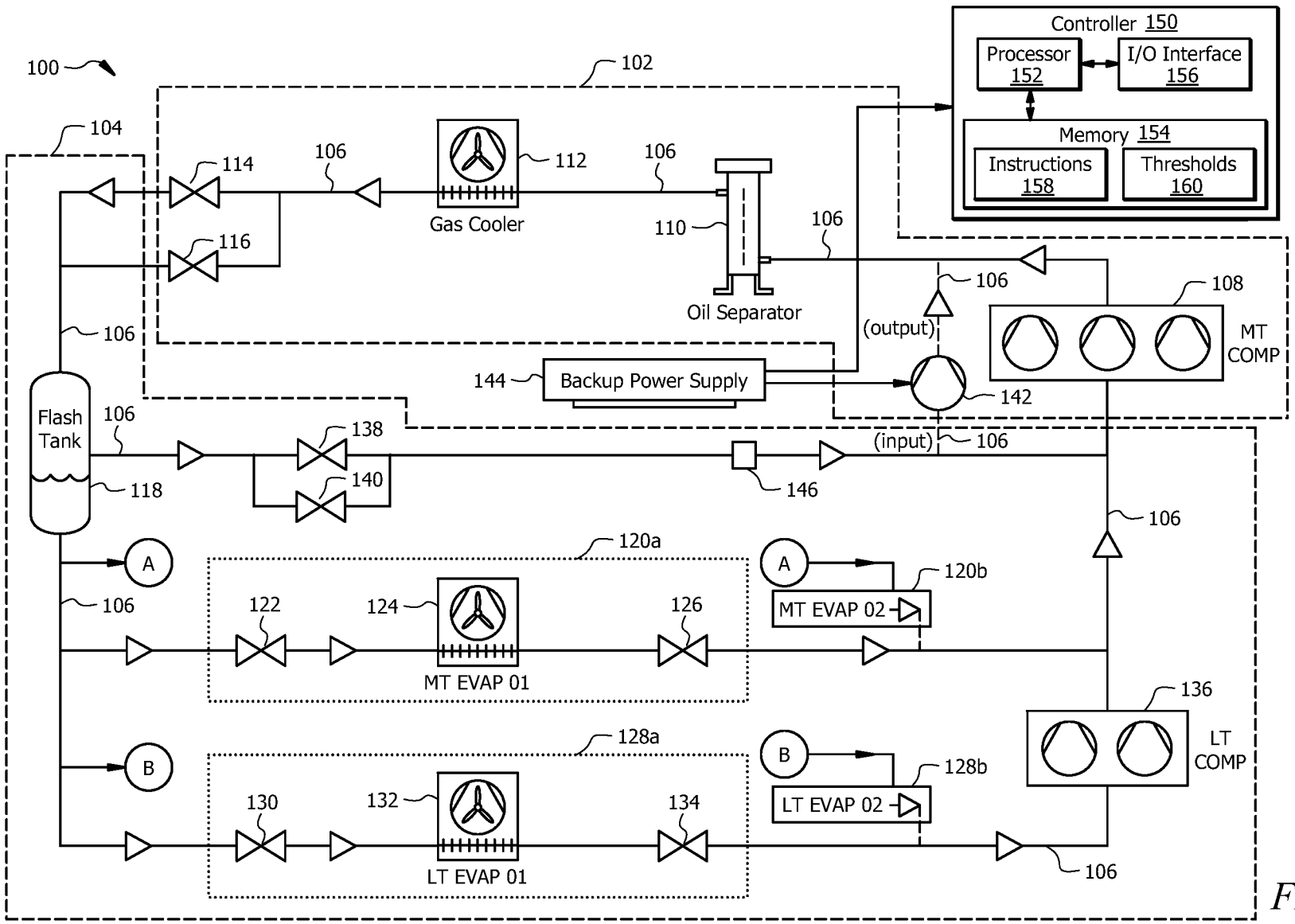
FIG. 2 is a block diagram illustrating the example refrigeration system of FIG. 1 operating in a backup power mode.

FIGS. 1 and 2 shows an example refrigeration system 100 operated in a normal refrigeration mode and a backup mode, respectively. Refrigeration system 100 includes a high-pressure side 102 and a low-pressure side 104. The high-pressure side 102 includes a gas cooler 112 that cools refrigerant on the high-pressure side 102 when the refrigeration system 100 is powered by a main power supply (see, e.g., power supply 402 of FIG. 4, described below) and is operating to provide refrigeration as in the configuration of FIG. 1. The low-pressure side 104 includes one or more evaporators 124, 132 that are each configured to cool a corresponding space when the refrigeration system 100 is powered by the main power supply and is operating to provide refrigeration as in the configuration of FIG. 1. In order to prevent excessive refrigerant pressures during a power outage, the refrigeration system 100 includes an auxiliary compressor 142 coupled to a backup power supply 144. The input of the auxiliary compressor 142 is coupled to the low-pressure side 104 and the output of the auxiliary compressor 142 is coupled to the high-pressure side 102. As described further below, when the main power supply is unavailable, the auxiliary compressor 142 is turned on to move refrigerant from the low-pressure side 104 to the high-pressure side 102.

Refrigeration system 100 includes refrigerant conduit subsystem 106, one or more medium-temperature (MT) compressors 108, oil separator 110, gas cooler 112, expansion valve 114, optional bypass valve 116, flash tank 118, one or more MT evaporator units 120*a,b*, one or more low-temperature (LT) evaporator units 128*a,b* one or more LT compressors 136, a flash gas bypass valve 138, optional bypass valve 140, the auxiliary compressor 142, backup power supply 144, one or more sensors 146, and controller 150. In some embodiments, refrigeration system 100 is a transcritical refrigeration system that circulates a transcritical refrigerant such as $CO_2$.

Refrigerant conduit subsystem 106 facilitates the movement of refrigerant (e.g., $CO_2$) through a refrigeration cycle such that the refrigerant flows in the refrigeration mode as illustrated by the arrows in FIG. 1 when the main power supply is available. The refrigerant conduit subsystem 106 includes conduit, tubing, and the like that facilitates the movement of refrigerant between components of the refrigeration system 100. The refrigerant conduit subsystem 106 includes any conduit, tubing, and the like that is illustrated in FIGS. 1 and 2 connecting components of the refrigeration system 100. Dashed lines in the Refrigerant conduit subsystem 106 of FIG. 2 indicate conduit in which refrigerant flow is typically prevented during backup mode operation.

The MT compressor(s) 108 compress refrigerant from the low-pressure side 104 and provide the resulting high-pressure refrigerant to the high-pressure side 102. The MT compressor(s) 108 includes one or more compressors. MT compressor(s) 108 may vary by design and/or by capacity. For example, some compressor designs may be more energy efficient than other compressor designs, and some MT compressors 108 may have modular capacity (e.g., a capability to vary capacity). The controller 150 may be in communication with the MT compressors 108 and controls their operation.

The oil separator 110 may be located downstream the MT compressors 108. The oil separator 110 is operable to separate compressor lubrication oil from the refrigerant. The refrigerant is provided to the gas cooler 112, while the oil may be collected and returned to the MT compressors 108, as appropriate.

Gas cooler 112 is generally operable to receive refrigerant (e.g., from MT compressor(s) 108 and/or oil separator 110) and apply a cooling stage to the received refrigerant. In some embodiments, gas cooler 112 is a heat exchanger comprising cooler tubes configured to circulate the received refrigerant and coils through which ambient air is forced. Inside gas cooler 112, the coils may absorb heat from the refrigerant, thereby cooling the refrigerant.

Expansion valve 114 is configured to receive liquid refrigerant from gas cooler 112 and reduce the pressure of the received refrigerant. In some embodiments, this reduction in pressure causes some of the refrigerant to vaporize. As a result, mixed-state refrigerant (e.g., refrigerant vapor and liquid refrigerant) may be discharged from expansion valve 114. In some embodiments, this mixed-state refrigerant is discharged to flash tank 118. When the main power supply is not available, the expansion valve 114 may be closed such that refrigerant flow from the high-pressure side 102 to the low-pressure side 104 is prevented. This approach holds the refrigerant, which may increase in temperature and pressure during a power outage, in the conduit of the high-pressure side 102 that is designed to tolerate a higher refrigerant pressure. The controller 150 may be in communication with valve 114 and control its operation.

Figure 4:
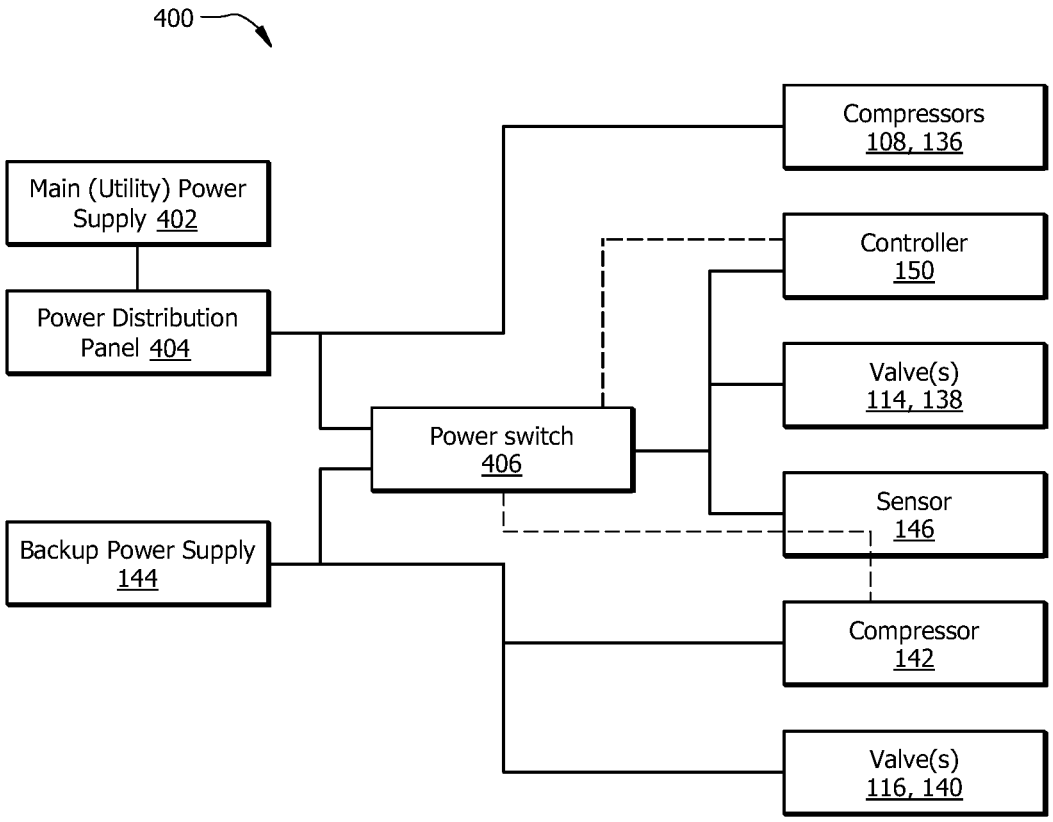
FIG. 4 is a block diagram illustrating the interconnectivity of example power supply-related components of a refrigeration system of this disclosure.

The refrigeration system 100 may include an optional bypass valve 116, which may be powered by the backup power supply 144 (see also FIG. 4). The bypass valve 116 may be a solenoid valve or other controllable valve. When the refrigeration system 100 is operated in the normal refrigeration mode of FIG. 1, bypass valve 116 is generally closed. Bypass valve 116 may be opened when the refrigeration system 100 operates using the backup power supply 144 in order to maintain the pressure on the high-pressure side 102 below a threshold value (e.g., a threshold of thresholds 160). When opened, valve 116 allows refrigerant to flow from the high-pressure side 102 to the low-pressure side 104 when the expansion valve 114 is closed. The controller 150 may be in communication with valve 116 and control its operation (e.g., the amount that the valve 116 is open).

Flash tank 118 is configured to receive mixed-state refrigerant and separate the received refrigerant into flash gas and liquid refrigerant. Typically, the flash gas collects near the top of flash tank 118 and the liquid refrigerant is collected in the bottom of flash tank 118. In some embodiments, the liquid refrigerant flows from flash tank 118 and provides cooling to the MT evaporator units 120*a,b* and LT evaporator units 128*a,b*.

When operated in refrigeration mode with the main power supply available (see FIG. 1), the MT evaporator units 120*a,b* and LT evaporator units 128*a,b* receive cooled liquid refrigerant from the flash tank 118 and use the cooled refrigerant to provide cooling. Each of the MT evaporator units 120*a,b* includes an evaporator 124 along with appropriate valves 122, 126 to facilitate operation of the MT evaporator units 120*a,b* in the refrigeration mode (see FIG. 1). As an example, the evaporator 124 may be part of a refrigerated case and/or cooler for storing food and/or beverages that must be kept at particular temperatures. For clarity and conciseness, the components of a single MT evaporator unit 120*a* are illustrated. The refrigeration system 100 may include any appropriate number of MT evaporator units 120*a,b* with the same or a similar configuration to that shown for the example MT evaporator unit 120*a*.

When the MT evaporator unit 120*a* is operating in the refrigeration mode of FIG. 1, liquid refrigerant from flash tank 118 flows through expansion valve 122, where the pressure of the refrigerant is decreased, before it reaches the evaporator 124. Expansion valve 122 may be the same as or similar to expansion valve 114, described above. Expansion valve 122 may be configured to achieve a refrigerant temperature into the evaporator 124 at a predefined temperature (e.g., about −6° C.). The controller 150 may be in communication with valves 122 and/or 126 and control their operation. For example, one or both of valves 122, 126 may be closed when the main power supply is unavailable to prevent flow of refrigerant from the flash tank 118 to the MT evaporator 124 (see FIG. 2).

Refrigerant from the MT evaporator units 120*a,b* that are operating in refrigeration mode (i.e., MT evaporator units 120*a* and 120*b* in FIG. 1) is provided to the one or more MT compressors 108. As described above, the MT compressor(s) 108 compress refrigerant discharged from the MT evaporator units 120*a* and/or 120*b* and provide supplemental compression to refrigerant discharged from any of the LT evaporator units 128*a,b* that are operating in refrigeration mode (LT evaporator units 128*a,b* are described further below).

LT evaporator units 128*a,b* are generally similar to the MT evaporator units 120*a,b* but configured to operate at lower temperatures (e.g., for deep freezing applications near about −30° C. or the like). When operated in refrigeration mode (see FIG. 1), the LT evaporator units 128*a,b* receive cooled liquid refrigerant from the flash tank 118 and use the cooled refrigerant to provide cooling. Each of the LT evaporator units 128*a,b* includes an evaporator 132 along with appropriate valves 130, 134 to facilitate operation of the LT evaporator units 128*a,b* in the refrigeration mode (see FIG. 1). As an example, the evaporator 132 may be part of a deep freezer for relatively long term storage of perishable that must be kept at particular temperatures. For clarity and conciseness, the components of a single LT evaporator unit 128*a* are illustrated. The refrigeration system 100 may include any appropriate number of LT evaporator units 128*a,b* with the same or a similar configuration to that shown for the LT evaporator unit 128*a*.

When the LT evaporator unit 128*a* is operating in the refrigeration mode illustrated in FIG. 1, liquid refrigerant from flash tank 118 flows through expansion valve 130, where the pressure of the refrigerant is decreased, before it reaches the evaporator 132. Expansion valve 130 may be the same as or similar to expansion valve 114, described above. Expansion valve 130 may be configured to achieve a refrigerant temperature into the evaporator 132 at a predefined temperature (e.g., about −30° C.). The controller 150 may be in communication with valves 130 and/or 134 and control their operation (e.g., amount valves 130 and/or 134 are open). One or both of valves 130, 134 may be closed when the main power supply is unavailable to prevent flow of refrigerant from the flash tank 118 to the LT evaporator 132 (see FIG. 2).

Refrigerant from the LT evaporator units 128*a,b* that are operating in refrigeration mode (i.e., LT evaporator units 120*a* and 120*b* in FIG. 1) is provided to the one or more LT compressors 136. The LT compressor(s) 136 are configured to compress refrigerant discharged from the LT evaporator units 128*a* and/or 128*b*. The compressed refrigerant from the LT compressors 136 is provided to the MT compressors 108 for supplemental compression. A pressure-relief valve (not shown for conciseness) may be located on the discharge side of the LT compressors 136 and configured to open to decrease pressure if the pressure is greater than a threshold value. Refrigeration system 100 may include any suitable number of LT compressors 136. LT compressor(s) 136 may vary by design and/or by capacity. For example, some compressor designs may be more energy efficient than other compressor designs, and some LT compressors 136 may have modular capacity (e.g., a capability to vary capacity). The controller 150 may be in communication with the LT compressors 136 and controls their operation.

Flash gas bypass valve 138 may be located in refrigerant conduit connecting the flash tank 118 to the MT compressors 108 and configured to open and close to permit or restrict the flow of flash gas discharged from flash tank 118. In some embodiments, controller 150 controls the opening and closing of flash gas bypass valve 138. As depicted in FIG. 1, closing flash gas bypass valve 138 may restrict flash gas from flowing to MT compressors 108 and opening flash gas bypass valve 138 may permit flow of flash gas to MT compressors 108. The controller 150 may be in communication with valve 138 and control its operation (e.g., the amount that the valve 138 is open).

The refrigeration system 100 may include an optional bypass valve 140, which may be powered by the backup power supply 144 (see also FIG. 4). When the refrigeration system 100 is operated in the normal refrigeration mode of FIG. 1, bypass valve 140 is generally closed. The bypass valve 140 may be a solenoid valve or other controllable valve. As described further below, bypass valve 140 may be opened when the refrigeration system 100 operates using the backup power supply 144 in order to allow flow of refrigerant from the flash tank 118 toward the auxiliary compressor 142 because the flash gas bypass valve 138 may automatically close when the main power supply is unavailable if the flash gas bypass valve 138 is not connected to the backup power supply 144. When opened, valve 140 allows refrigerant to flow toward the auxiliary compressor 142 even when the flash gas bypass valve 138 is closed. Refrigerant following this path may return to the high-pressure side 102. The controller 150 may be in communication with valve 140 and control its operation (e.g., the amount that the valve 140 is open).

Figure 3:
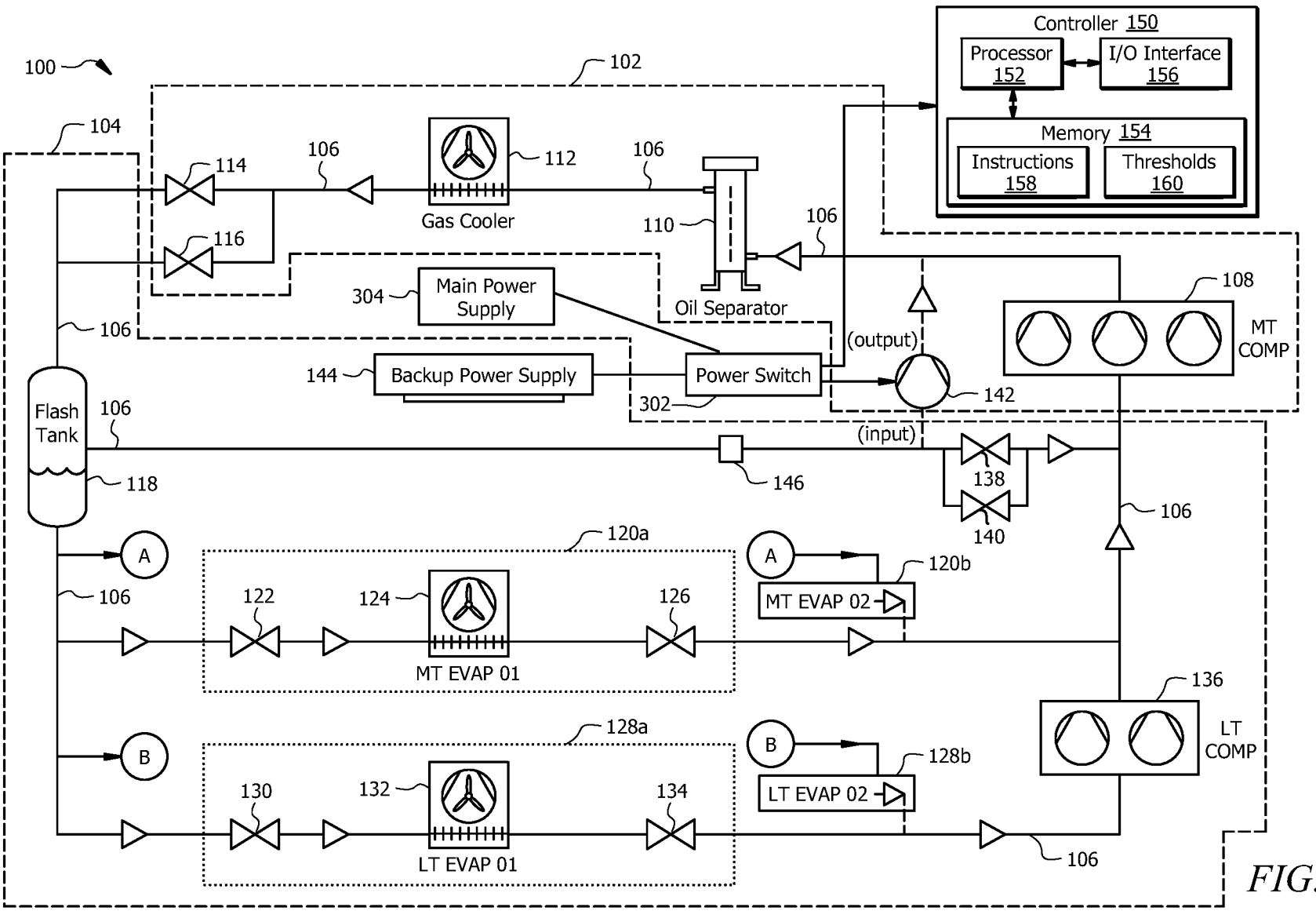
FIG. 3 is a block diagram illustrating another example refrigeration system of this disclosure operating in a backup power mode.

The auxiliary compressor 142 is connected to fluid conduit coupling the low-pressure side 104 to the high-pressure side 102. In the example of FIGS. 1 and 2, the auxiliary compressor 142 is located downstream from the flash gas bypass valve 138 and upstream from the MT compressors 108. The auxiliary compressor 142 is configured, when turned on, to move refrigerant from the low-pressure side 104 to the high-pressure side 102. FIG. 3 (described below) shows an alternative configuration of a refrigeration system 300 in which the auxiliary compressor 142 is at a different location upstream from the flash gas bypass valve 138.

The auxiliary compressor can be a compressor that is the same as or similar to the MT and/or LT compressors 108, 136 or any other device capable of moving refrigerant from the low-pressure side 104 to the high-pressure side 102 of the refrigeration system 100. For example, the auxiliary compressor 142 may be a compressor, an expander (e.g., a scroll expander), a fluid pump, or the like. The power capacity of the auxiliary compressor 142 may be less than that of the MT compressors 108 and/or LT compressors 136.

For example, the power capacity of the auxiliary compressor 142 may be less than 10 horsepower (HP). In some cases, the power capacity of the auxiliary compressor 142 is in a range from 0.5 to 5 HP. In some cases, the power capacity of the auxiliary compressor 142 is in a range from 0.5 to 3 HP. In contrast, the MT compressors 108 and LT compressors 136 generally operate at much higher powers from about 10 to 40 HP. The use of a lower capacity auxiliary compressor 142 may allow the refrigeration system 100 to operate efficiently during a power outage when the increased compression of the higher power MT compressors 108 and LT compressors 136 may not be necessary.

The backup power supply 144 may supply power to one or more components of the refrigeration system 100 during a power outage. For example, backup power supply 144 may include one or more generators that are automatically switched on in the case of a power outage. In some embodiments, controller 150 may determine the amount of power supplied by backup power supply 144. For example, controller 150 may have saved in memory 154 the amount of power provided by backup power supply 144. As additional examples, controller 150 may determine the wattage or voltage available, the total amount of power available (e.g., over what period of time the power may be supplied), and/or the number of generators available. For example, controller 150 may determine the amount of power available from one generator. However, if a user or operator requires additional support during the power outage, an additional generator may be brought in and/or turned on. This may allow controller 150 to determine the additional amount of power available and provide additional compression via auxiliary compressor 142 to refrigerant and/or provide backup mode operation during a power outage for an extended period of time.

The refrigeration system 100 may include sensors for measuring the temperature and/or pressure of refrigerant at various locations. For example, a pressure sensor 146 may be disposed in the low-pressure side 104. Pressure sensor 146 measures refrigerant pressure in the conduit of the refrigerant conduit subsystem 106 in the low-pressure side 104. The controller 150 may receive this information and use it to control operation of the auxiliary compressor 142 during a power outage. For example, the controller 150 may operate the auxiliary compressor 142 to maintain the refrigerant pressure in the low-pressure side 104 at or below a threshold vale (e.g., a threshold of thresholds 160). This may be achieved, for example, by turning the auxiliary compressor 142 on and off for appropriate intervals to maintain the pressure on the low-pressure side below a threshold value while the main power supply is unavailable.

As described above, controller 150 is in communication with components of the refrigeration system 100, including the auxiliary compressor 142, valves 114, 116, 122, 126, 130, 134, 138, and/or 140, the MT compressors 108, and the LT compressors 136. The controller 150 determines that a main power supply is unavailable for operating the refrigeration system 100 in the normal refrigeration configuration of FIG. 1. In response, the controller 150 closes one or more valves 114, 122, 126, 130, 134 to prevent flow of refrigerant from the high-pressure side 102 to the low-pressure side 104 and powers the auxiliary compressor 142 using the backup power supply 144. The auxiliary compressor 142 moves refrigerant from the low-pressure side 104 to the high-pressure side 102.

The controller includes a processor 152, memory 154, and input/output (I/O) interface 156. The processor 152 includes one or more processors operably coupled to the memory 154. The processor 152 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 154 and controls the operation of refrigeration system 100.

The processor 152 may be a programmable logic device, a microcontroller, a microprocessor, or any suitable combination of the preceding. The processor 152 is communicatively coupled to and in signal communication with the memory 154. The one or more processors are configured to process data and may be implemented in hardware or software. For example, the processor 152 may be 8-bit, 16-bit, 32-bit, 64-bit or of any other suitable architecture. The processor 152 may include an arithmetic logic unit (ALU) for performing arithmetic and logic operations, processor registers that supply operands to the ALU and store the results of ALU operations, and a control unit that fetches instructions from memory 154 and executes them by directing the coordinated operations of the ALU, registers, and other components. The processor 152 may include other hardware and software that operates to process information, control the refrigeration system 100, and perform any of the functions described herein (e.g., with respect to FIGS. 1-5). The processor 152 is not limited to a single processing device and may encompass multiple processing devices. Similarly, the controller 150 is not limited to a single controller but may encompass multiple controllers.

The memory 154 includes one or more disks, tape drives, or solid-state drives, and may be used as an over-flow data storage device, to store programs when such programs are selected for execution, and to store instructions and data that are read during program execution. The memory 154 may be volatile or non-volatile and may include ROM, RAM, ternary content-addressable memory (TCAM), dynamic random-access memory (DRAM), and static random-access memory (SRAM). The memory 154 is operable (e.g., or configured) to store information used by the controller 150 and/or any other logic and/or instructions for performing the function described in this disclosure. For example, the memory 154 may store instructions 158 for performing the functions of the controller 150 described in this disclosure. The memory 154 may store thresholds 160, such as a threshold pressure above which the low-pressure side 104 should not be allowed to reach during a power outage and any other threshold or setpoint value described in this disclosure.

The I/O interface 156 is configured to communicate data and signals with other devices. For example, the I/O interface 156 may be configured to communicate electrical signals with components of the refrigeration system 100 including the compressors 108, 136, 142, gas cooler 112, valves 114, 116, 122, 126, 130, 134, 138, 140, evaporators 124, 132, and sensor 146. The I/O interface 156 may be configured to communicate with other devices and systems. The I/O interface 156 may provide and/or receive, for example, compressor speed signals, compressor on/off signals, temperature signals, pressure signals, temperature setpoints, environmental conditions, and an operating mode status for the refrigeration system 100 and send electrical signals to the components of the refrigeration system 100. The I/O interface 156 may include ports or terminals for establishing signal communications between the controller 150 and other devices. The I/O interface 156 may be configured to enable wired and/or wireless communications.

Although this disclosure describes and depicts refrigeration system 100 including certain components, this disclosure recognizes that refrigeration system 100 may include any suitable components. As an example, refrigeration system 100 may include one or more additional sensors configured to detect temperature and/or pressure information. In some cases, one or more of the compressors 108, 136, 142, gas cooler 112, flash tank 118, and evaporators 124, 132 include one or more sensors.

In an example operation of the refrigeration system 100, the refrigeration system 100 is initially operated according to the normal refrigeration mode of FIG. 1. Subsequently, a power outage occurs such that a main power supply (e.g., main power supply 402 of FIG. 4, described below) is unavailable. After this time, the refrigeration system 100 is operated in the backup power configuration of FIG. 2. For example, valve 114 may be closed and compressor 142 may be powered on using the backup power supply 144. The controller 150 may operate the auxiliary compressor 142 to maintain the pressure of refrigerant in the low-pressure side 104 at or below a threshold 160. If flash gas bypass valve 138 automatically closed due to lack of power during the power outage, valve 140 may be at least partially opened. If the pressure in the high-pressure side 102 becomes too high, valve 116 may opened at least partially to allow refrigerant to flow to the low-pressure side 104. Valve 122 and/or 130 may be closed to prevent refrigerant from flash tank 118 from flowing to corresponding evaporators 124 and/or 132. This may reduce heating of refrigerant via heat transfer at the evaporators 124, 132. When power is restored to the refrigeration system 100, the refrigeration system 100 returns to the normal refrigeration configuration of FIG. 1.

FIG. 3 shows an example of an alternate refrigeration system 300 in the backup power configuration. The alternate refrigeration system 300 of FIG. 3 is the same as refrigeration system 100 of FIGS. 1 and 2 but has the auxiliary compressor 142 upstream of the flash gas bypass valve 138. The inlet of the auxiliary compressor 142 is coupled to fluid conduit upstream from the flash gas bypass valve 138 on the low-pressure side 104. A power switch 302 is coupled to the auxiliary compressor 142. The power switch 302 can provide power to the auxiliary compressor 142 from a main power supply 304 (e.g., a utility power supply) when the main power supply 304 is available (e.g., when there is no power outage). The controller 150 may cause the auxiliary compressor 142 to turn on while powered by the main power supply 304, for example, to improve performance of the refrigeration system 300 during normal operation. The power switch 302 may provide power to the auxiliary compressor 142 from the backup power supply 144 when the main power supply 304 is not available. The refrigeration system 100 of FIGS. 1 and 2 does not necessarily require but may include a similar power switch to that of power switch 302 of FIG. 3. Further details of example connections between components of refrigeration systems 100, 300 of this disclosure and various power supplies are illustrated in FIG. 4 and described below.

Example Connectivity to Power Sources

FIG. 4 is a diagram illustrating the distribution of power to components of an example refrigeration system 400. Example system 400 may include any appropriate refrigeration system configuration for operating in the backup mode as described in this disclosure. For example, components of refrigeration system 400 may correspond to those of refrigeration system 100 of FIGS. 1 and 2 or refrigeration system 300 of FIG. 3 with additional components illustrating the connectivity of components to different power supplies. Refrigeration system 400 includes utility power 402 (e.g., main power supply 304 of FIG. 3), power distribution panel 404, backup electric power supply 144, power switch 406 (e.g., the same as or similar to power switch 302 of FIG. 3), controller 150, MT and LT compressors 108, 136, valves 114, 138, sensor 146, auxiliary compressor 142, bypass valves 116, 140, and any other electrically powered components of the refrigeration system 400.

Power switch 406 may route power from backup power supply 144 to controller 150 and, optionally, other components of the refrigeration system 400, such as sensor 146, as shown in the example of FIG. 4. Power switch 406 may be used when there is an issue with utility power 402, such as a power outage. Power switch 406 may indicate or communicate to controller 150 that system 100 has experienced a power outage and that backup power supply 144 should be used. In general, the power switch 406 provides power to the controller 150 from the main power supply 402 when the main power supply 402 is available and provides power to the controller 150 from the backup power supply 144 when the main power supply 402 is not available. In some embodiments, a separate controller that is powered directly by the backup power supply 144 may be employed during backup power operations to control operation of the auxiliary compressor 142, such that power switch 406 is not needed for controller 150.

During regular use, utility power 402 provides power to most components of the refrigeration system 400, allowing it to perform cooling and refrigeration. Main distribution panel 404 provides power from utility power 402 to any components of refrigeration system 400 that require power to function, for example, controller 150 and compressors 108, 136. In some embodiments, main distribution panel 404 provides power directly to certain components, while other components (e.g., the controller 150) are powered through power switch 406. When there is a power outage, utility power 402 may be inaccessible such that refrigeration system 400 may be limited with respect to the refrigeration it can provide. Further, as discussed above, if no power is supplied to refrigeration system 400, refrigerants in flash tank 118 may start gaining heat such that the refrigerant pressure may rise and exceed the design pressure of the low-pressure side 104. In order to reduce or limit the pressure building up in flash tank 118, it may be beneficial to provide power to the auxiliary compressor 142 to alleviate or limit pressure build up in the low-pressure side 104. In some embodiments (e.g., as shown in FIGS. 1 and 2), the backup power supply 144 is connected to the auxiliary compressor 142 and optional bypass valves 116, 140. By having the backup power supply 144 connected directly to the auxiliary compressor 142 (i.e., without using power switch 406), the complexity of controls for switching between power supplies is simplified, resulting in a decreased probability of system failure. In other embodiments (e.g., as shown in FIG. 3), power switch 406 controls the power delivered to the auxiliary compressor 142 from backup power supply 144 (see dashed lines of FIG. 4).

Example Method of Operation

Figure 5:
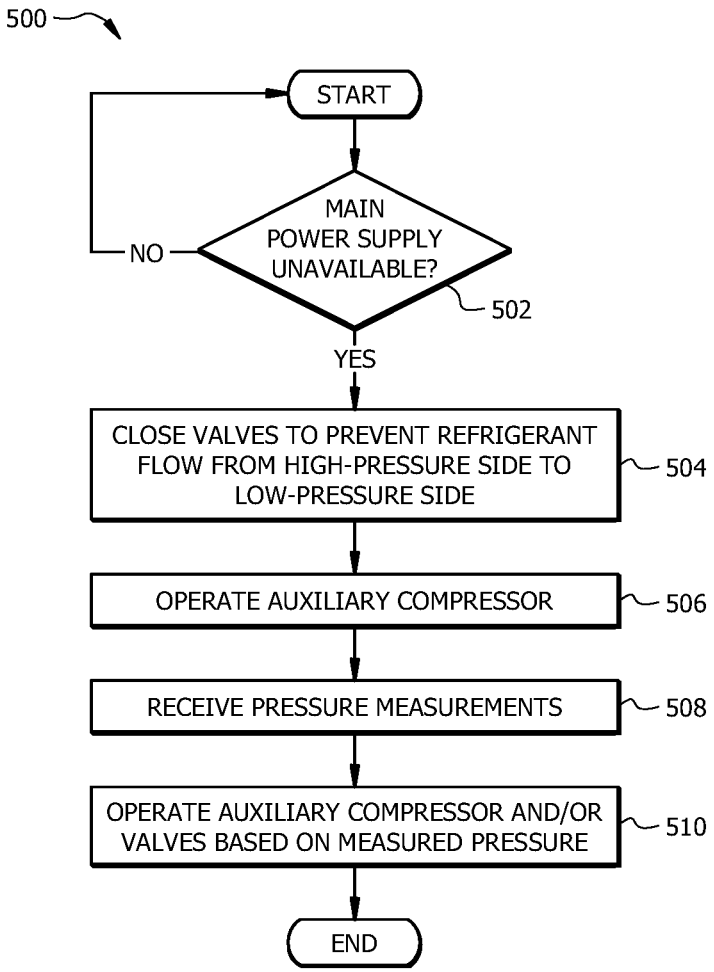
FIG. 5 is a flowchart of an example process for operating a refrigeration system of this disclosure.

FIG. 5 illustrates an example method 500 of operating the refrigeration systems 100, 300, 400 described above with respect to FIGS. 1-4. The method 500 may be implemented using the processor 152, memory 154, and I/O interface 156 of the controller 150 of FIGS. 1-3. The method 500 may begin at operation 502 where the controller 150 determines whether a main power supply is unavailable. If the main power supply is unavailable, the controller 150 proceeds to operation 504 and closes one or more valves (e.g., valve 114) to prevent refrigerant flow from the high-pressure side 102 to the low-pressure side 104. Valve 114 may close automatically when power to the valve 114 is lost during the power outage. At operation 506, the controller 150 operates the auxiliary compressor that is powered by the backup power supply 144, as described above with respect to FIGS. 1-4. At operation 508, the controller 150 receives measurements of the pressure of refrigerant at one or more locations of the refrigeration system 100, 300, 400. At operation 510, the controller 150 uses this pressure information to adjust operation of the auxiliary compressor 142 and/or one or more of the valves 116, 140. For example, the auxiliary compressor 142 may be turned on and off using any appropriate control algorithm to maintain a pressure in the low-pressure side 104 below a threshold 160.

Modifications, additions, or omissions may be made to method 500 depicted in FIG. 5. Method 500 may include more, fewer, or other steps. For example, steps may be performed in parallel or in any suitable order. While at times discussed as controller 150, refrigeration system 100, 300, 400 or components thereof performing the steps, any suitable refrigeration system or components of the refrigeration system may perform one or more steps of the method 500.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A refrigeration system, comprising:

a high-pressure side, the high-pressure side comprising a gas cooler configured, while the refrigeration system is powered by a main power supply and is operating to provide refrigeration, to cool refrigerant on the high-pressure side;

a low-pressure side comprising one or more evaporators, wherein each of the one or more evaporators is configured, while the refrigeration system is powered by the main power supply and is operating to provide refrigeration, to cool a corresponding space;

an auxiliary compressor coupled to a backup power supply, wherein an input of the auxiliary compressor is coupled to fluid conduit of the low-pressure side and an output of the auxiliary compressor is coupled to fluid conduit of the high-pressure side; and a controller communicatively coupled to the auxiliary compressor, wherein the controller is configured to:

determine that the main power supply is unavailable; and after determining that the main power supply is unavailable, cause the auxiliary compressor to turn on to move refrigerant from the low-pressure side to the high-pressure side;

wherein the controller is further configured to turn the auxiliary compressor on and off to maintain a pressure on the low-pressure side below a threshold value while the main power supply is unavailable.

2. The refrigeration system of claim 1, further comprising an expansion valve disposed between the high-pressure side and the low-pressure side, wherein:

the expansion valve is at least partially open while the refrigeration system is powered by the main power supply and is operating to provide refrigeration; and the expansion valve is closed when the main power supply is unavailable, such that refrigerant flow from the high-pressure side to the low-pressure side is prevented.

3. The refrigeration system of claim 2, wherein:

the refrigeration system further comprises a solenoid valve disposed between fluid conduit connecting the high-pressure side to the low-pressure side; and the controller is further communicatively coupled to the solenoid valve and configured to cause the solenoid valve to at least partially open to allow a flow of refrigerant from the high-pressure side to the low-pressure side while the main power supply is unavailable.

4. The refrigeration system of claim 1, further comprising an expansion valve disposed between a flash tank of the low-pressure side and a first evaporator of the one or more evaporators, wherein:

the expansion valve is at least partially open while the refrigeration system is powered by the main power supply and is operating to provide refrigeration, such that refrigerant is allowed to flow from the flash tank to the first evaporator; and the expansion valve is closed when the main power supply is unavailable, such that refrigerant flow from the flash tank to the first evaporator is prevented.

5. The refrigeration system of claim 1, wherein the inlet of the auxiliary compressor is coupled to fluid conduit downstream from a flash gas bypass valve on the low-pressure side.

6. The refrigeration system of claim 1, wherein the inlet of the auxiliary compressor is coupled to fluid conduit upstream from a flash gas bypass valve on the low-pressure side.

7. The refrigeration system of claim 6, further comprising a power switch coupled to the auxiliary compressor, wherein the power switch is configured to:

provide power to the auxiliary compressor from the main power supply when the main power supply is available; and provide power to the auxiliary compressor from the backup power supply when the main power supply is not available.

8. The refrigeration system of claim 6, wherein the controller is further configured to cause the auxiliary compressor to turn on while powered by the main power supply.

9. The refrigeration system of claim 1, further comprising a power switch coupled to the controller, wherein the power switch is configured to:

provide power to the controller from the main power supply when the main power supply is available; and provide power to the controller from the backup power supply when the main power supply is not available.

10. A controller of a refrigeration system, comprising:

an input/output interface communicatively coupled to an auxiliary compressor coupled to a backup power supply, wherein an input of the auxiliary compressor is coupled to fluid conduit of a low-pressure side of the refrigeration system and an output of the auxiliary compressor is coupled to fluid conduit of a high-pressure side of the refrigeration system; and a processor communicatively coupled to the input/output interface, wherein the processor is configured to:

determine that a main power supply is unavailable for operating the refrigeration system in a normal refrigeration mode; and after determining that the main power supply is unavailable, cause the auxiliary compressor to turn on to move refrigerant from the low-pressure side to the high-pressure side;

wherein the processor is further configured to turn the auxiliary compressor on and off to maintain a pressure on the low-pressure side below a threshold value while the main power supply is unavailable.

11. The controller of claim 10, wherein:

the input/output interface is further communicatively coupled to an expansion valve disposed between the high-pressure side and the low-pressure side; and the processor is further configured to cause:

the expansion valve to be at least partially open while the refrigeration system is powered by the main power supply and is operating to provide refrigeration; and the expansion valve to be closed when the main power supply is unavailable, such that refrigerant flow from the high-pressure side to the low-pressure side is prevented.

12. The controller of claim 11, wherein:

the input/output interface is further communicatively coupled to a solenoid valve disposed between fluid conduit connecting the high-pressure side to the low-pressure side; and the processor is further configured to cause the solenoid valve to at least partially open to allow a flow of refrigerant from the high-pressure side to the low-pressure side while the main power supply is unavailable.

13. The controller of claim 10, wherein:

the input/output interface is further communicatively coupled to an expansion valve disposed between a flash tank of the low-pressure side and a first evaporator of the refrigeration system; and the processor is further configured to cause:

the expansion valve to be at least partially open while the refrigeration system is powered by the main power supply and is operating to provide refrigeration, such that refrigerant is allowed to flow from the flash tank to the first evaporator; and the expansion valve to be closed when the main power supply is unavailable, such that refrigerant flow from the flash tank to the first evaporator is prevented.

14. The controller of claim 10, wherein the inlet of the auxiliary compressor is coupled to fluid conduit downstream from a flash gas bypass valve on the low-pressure side.

15. The controller of claim 10, wherein the inlet of the auxiliary compressor is coupled to fluid conduit upstream from a flash gas bypass valve on the low-pressure side.

16. The controller of claim 15, wherein the input/output interface is further communicatively coupled to a power switch coupled to the auxiliary compressor, wherein the power switch is configured to:

provide power to the auxiliary compressor from the main power supply when the main power supply is available; and provide power to the auxiliary compressor from the backup power supply when the main power supply is not available.

17. The controller of claim 15, wherein the processor is further configured to cause the auxiliary compressor to turn on while powered by the main power supply.

18. The controller of claim 10, wherein the input/output interface is further communicatively coupled to a power switch, wherein the power switch is configured to:

provide power to the controller from the main power supply when the main power supply is available; and provide power to the controller from the backup power supply when the main power supply is not available.

* * * * *